US005549300A

United States Patent [19]

Sardarian

[11] Patent Number: 5,549,300

[45] Date of Patent: Aug. 27, 1996

[54] METHOD OF PLAYING A BLACKJACK CARD GAME

[76] Inventor: Seroj Sardarian, 550 Oakmont Ave., #1504, Las Vegas, Nev. 89119

[21] Appl. No.: 350,891

[22] Filed: Dec. 7, 1994

[51] Int. Cl.[6] ..... A63F 1/00

[52] U.S. Cl. ..... 273/292; 273/306; 273/274

[58] Field of Search ..... 273/292, 274, 273/309, 306

[56] References Cited

U.S. PATENT DOCUMENTS

| | | | |
|---|---|---|---|
| 5,013,049 | 5/1991 | Tomaszewski | 273/292 |
| 5,072,946 | 12/1991 | Miller | 273/292 |
| 5,275,415 | 1/1994 | Wisted | 273/274 |
| 5,314,193 | 5/1994 | Ferrer | 273/292 |
| 5,366,228 | 11/1994 | Kangsanaraks | 273/292 |

OTHER PUBLICATIONS

Scarne's Encyclopedia of Games, "Banking Card Games", pp. 276–287, Harper & Row Publishers 1973.

*Primary Examiner*—Benjamin H. Layno

*Attorney, Agent, or Firm*—John E. Roethel

[57] ABSTRACT

The game uses a deck of fifty-two cards comprising 4 deuces, 4 threes, 4 fours, 8 fives, 8 sixes, 8 sevens, 4 eights, 4 nines, 4 tens and 4 wild cards (Jokers). All cards count their face value and the Jokers count one or ten at the player's option. Each player and the dealer initially receive two cards. The player draws additional cards until he decides to stop or the numerical count of his hand exceeds twenty. In the event his numerical count exceeds twenty, a count of ten is subtracted from the numerical count and the resulting number is the player's hand total. The dealer draws whenever his numerical count is sixteen or less and the dealer stays when his numerical count is seventeen or higher. If the dealer's count exceeds twenty, a count of ten is subtracted from the dealer's count and the resulting number is the dealer's hand total. In the event that the dealer's numerical count is exactly twenty-one, a count of ten is subtracted from the dealer's count and the dealer receives one more card to create his final hand. The winning hand is the hand closest to a numerical count of twenty. If either the Dealer or the Player receive two tens as the first two cards, the hand is a Natural and is an automatic winner. If both the Dealer and the Player receive a Natural, the hand is a push. A Joker cannot be used in a Natural.

16 Claims, 1 Drawing Sheet

METHOD OF PLAYING A BLACKJACK CARD GAME

This invention relates to a casino card game, and more particularly to casino card game which is a variation of Twenty-One utilizing a deck of playing cards that uses deuces, threes, fours, fives, sixes, sevens, eights, nines and wild cards.

BACKGROUND OF THE INVENTION

Twenty-One (also called Blackjack) is a game of chance between a dealer and one or more players. The object is for the player to achieve a count of his hand closer to a numerical count of twenty-one than the count of the hand of the dealer; but if the count of the player's hand goes over a numerical count of twenty-one, then the player loses regardless of the final count of the dealer's hand.

The conventional manner of play of Twenty-One is as follows: A standard deck of playing cards is used and each card counts its face value, except Aces which have a value of one or eleven as is most beneficial to the count of the hand. Each player initially receives two cards. The dealer also receives two cards. One of the dealer's cards is dealt face down and the other of the dealer's cards is dealt face-up. In some gaming establishments, the dealer receives his two cards at the same time that each player is dealt his two cards. In other gaming establishments, the dealer initially only receives one card which becomes the dealer's "up" card. After each player has taken additional cards, the dealer then receives his second card.

A player may draw additional cards (take "hits") in order to try and beat the count of the dealer's hand. If the player's count exceeds a numerical count of twenty-one, the player "busts." The player may "stand" on any count of twenty-one or less. When a player busts, he loses his wager regardless of whether or not the dealer busts.

After all of the players have taken hits or have stood on their hand, the dealer "stands" or "hits" based on pre-established rules for the game. Typically, if the dealer has less than seventeen numerical count, the dealer must take a hit. If the dealer has a numerical count of seventeen or more, the dealer stands.

As the game of Twenty-One is played in most legalized gaming establishments, the conventional manner of play requires the dealer to take a hit whenever the dealer's hand is a "soft 17" count. However in other gaming establishments, the dealer stands on a "soft 17" count. The term "soft" means that the Ace is valued as a count of eleven, instead of as a count of one. A soft 17 occurs when the dealer has an Ace and a Six (or multiple cards that add up to six). The dealer will stand on soft 18's, soft 19's and soft 20's.

After the dealer's final hand has been established, the numerical count of the dealer's hand is compared to the numerical count of the player's hand. If the dealer busts, the player wins regardless of the numerical count of his hand. If neither the player nor the dealer have busted, the closest hand to a numerical count of twenty-one, without going over, wins; tie hands are a "push."

One of the problems with Twenty-One is that the player automatically loses whenever the numerical count of his hand exceeds twenty-one. Even if the dealer also "busts", the player still loses when the player "busts". This is quite aggravating to the player and there is seen to be a need in the gaming industry for a game similar to Twenty-One, but in which the player cannot "bust" and always retains an opportunity to achieve a winning hand.

It is an object of the present invention to provide a card game similar in form to the game of Twenty-One, but in which different play options are provided by modifying the deck of cards used. Wild cards are used that count one or ten at the option of the player, while all of the Aces and Face cards (the Kings, Queens and Jacks) are removed and replaced by additional pip cards.

It is a feature of the present invention to play a game in which the object is to get closest to a numerical hand count of twenty. If the numerical count of the cards exceeds twenty, then the numerical count reverts by subtracting ten therefrom. In this manner, the player never encounters a "bust" hand situation.

It is an advantage of the present invention that the options of the game of the present invention exceed those present in conventional Twenty-One while at the same time providing a game that is easy for any player to understand, particularly for those players who have encountered conventional Twenty-One previously.

Other objects, features and advantages of the present invention will become apparent from a consideration of the following detailed description.

SUMMARY OF THE INVENTION

The game of the present invention is practiced using a deck of fifty-two playing cards comprising deuces, threes, fours, fives, sixes, sevens, eights, nines, tens and wild cards. In the preferred embodiment, the deck of playing cards comprises 4 deuces, 4 threes, 4 fours, 8 fives, 8 sixes, 8 sevens, 4 eights, 4 nines, 4 tens and 4 wild cards (which can simply be Jokers). All cards count their face value and the wild cards (the Jokers) count one or ten at the option of the player. Each player plays his own hand against the dealer. The object of the game is to get closest to the numerical total of twenty.

At the start of the game, each player and the dealer receive two cards. The player has the option of drawing additional cards until he decides to stop drawing cards or the numerical count of his hand exceeds twenty. In the event the numerical count of the hand exceeds twenty, a count of ten is subtracted from the player's numerical count and the resulting number is the player's hand total.

The dealer draws whenever his numerical count is sixteen or less and the dealer stays when his numerical count is seventeen or higher. If the dealer's numerical count exceeds twenty, a count of ten is subtracted from the dealer's numerical count and the resulting number is the dealer's hand total. In the event that the dealer achieves a numerical count of exactly twenty-one, a count of ten is subtracted from the dealer's count and the dealer receives one more card to create his final hand.

The winning hand is the hand closest to a numerical count of twenty. If the first two cards in either the Dealer's hand or the Player's hand are two tens, this hand is a Natural and is an automatic winner. If both the Dealer and the Player receive two tens (a Natural), then the hand is a push. A Joker cannot be used in a Natural.

DETAILED DESCRIPTION OF THE PREFERRED EMBODIMENTS

Figure 1:
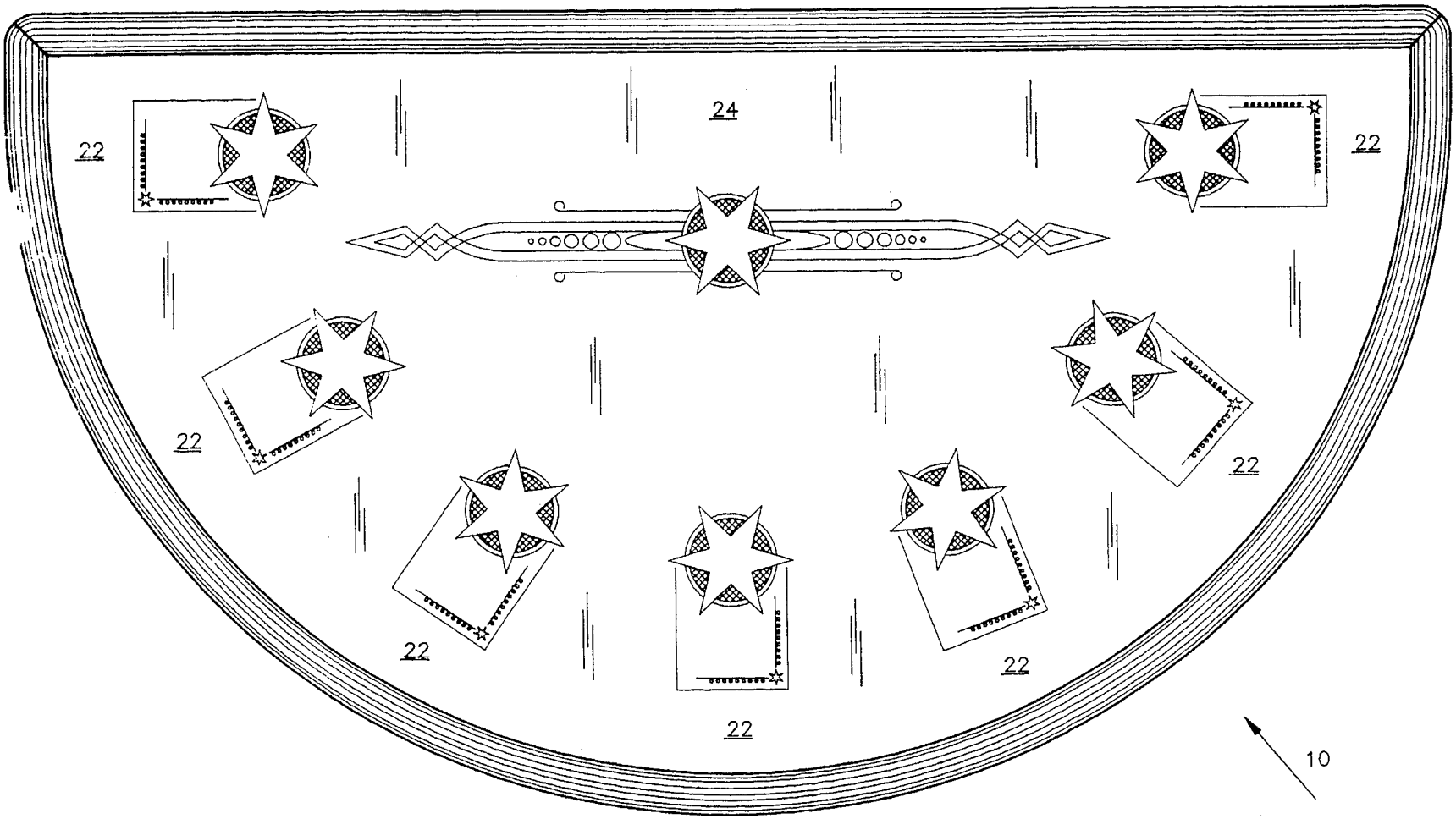
FIG. 1 shows a gaming table layout upon which the method of the present invention can be practiced.

The method of the present invention can be practiced on a conventional gaming table using a table layout shown generally at 10 in FIG. 1. The table layout 10 includes a plurality of player betting locations 22 arranged around the outer periphery of the table. In the preferred embodiment, seven player betting locations are provided, although fewer or more could be used. The dealer as is conventional stands at dealer location 24. From the dealer location 24, the dealer has access to the dealing shoe 24 which contains the playing cards used in the method of play. The dealer also has access to a conventional chip rack and a conventional money drop slot (not shown). The operation of the game is similar to the conventional manner of operation of a game of Twenty-One, except as modified by the method of play to be herein described. For example, if the game is using a single deck of playing cards, the game can be hand dealt by the dealer. However, if multiple decks of playing cards are being used, then the game should be dealt using a dealing shoe, such as a six-deck shoe or an eight-deck shoe.

The deck of cards used in the method of the present invention comprises a conventional fifty-two card deck which is then modified by the deletion of all Aces and Face cards (Kings, Queens and Jacks). The sixteen cards deleted are replaced with 4 wild cards (most usually Jokers, although any suitable card configuration can be used as long as it is readily apparent to the players that these cards are to be treated as wild cards). The other twelve cards are additional cards added having markings of deuce through nine, inclusive, at the option of the operator of the game.

In the first preferred embodiment, the twelve extra cards are fives, sixes and sevens. Therefore, the resulting fifty-two card deck in the first preferred embodiment comprises 4 deuces, 4 threes, 4 fours, 8 fives, 8 sixes, 8 sevens, 4 eights, 4 nines, 4 tens and 4 wild cards (which again can simply be Jokers). In the play of the game, each card has a numerical count equal to its face value (the number of pips thereon) and the wild card (Joker) has a value of one or ten at the option of the player.

Each player competes only against the dealer, not against the other players. The winning hand between a player and the dealer is the higher hand by numerical count. A numerical count of twenty is the highest possible hand.

At the beginning of each round of play, two cards are dealt to each player and two cards to the dealer. In order around the gaming table, each player has the opportunity to draw additional cards to improve the numerical count of his hand. A player may stand at any time or may continue drawing cards until the numerical count of his hand exceeds twenty. When a player's numerical count of his hand exceeds twenty, the sum of ten is subtracted from his total and the resulting numerical count is that player's final total.

After all players have completed the play of their hands, the dealer stands or draws additional cards in accordance with the following dealer's hand draw rules: if the numerical count of the dealer's hand is sixteen or less, the dealer draws a card. If the numerical count of the dealer's hand is seventeen or more, the dealer stands. If the numerical count of the dealer's hand exceeds twenty, the sum of ten is subtracted and the resulting numerical count is the dealer's total. The only exception to this procedure occurs when the dealer achieves a numerical count of exactly twenty-one. In that instance, the sum of ten is subtracted from the dealer's numerical total and the dealer receives one more card. The resulting numerical count is the dealer's total.

After the dealer's final hand has been determined, each of the player's hand is compared to the dealer's hand to determine which hand is the winning hand. The hand with the higher numerical count is the winning hand. If the player's hand and the dealer's hand have the same numerical count, then a tie hand exists.

The best possible hand for either the dealer or the player is a numerical count of twenty. The player or the dealer can achieve this count on the initial deal by receiving either two tens, two Jokers or a ten and a Joker. If the player achieves a numerical total of twenty on the first two cards, then the player automatically wins (unless the dealer also has a two card numerical total of twenty, in which case a tie hand exists).

If the dealer receives a numerical total of twenty in the initial two cards, the round of the game automatically ends. The dealer wins all hands against the players (except for the players who also have a two card numerical total of twenty, in which case a tie hand exists).

If the dealer does not receive a numerical total of twenty on the first two cards, the game continues with each player drawing additional cards as desired and the dealer receiving additional cards according to the dealer's hand draw rules as described above.

The method of the present invention can be played as a casino game of chance. Each player makes a wager to participate in the round of the game and the player is paid appropriate payoffs whenever the player achieves a winning hand. In the preferred embodiment, the player receives payout odds of one-to-one on his wager whenever the player's numerical total beats the dealer's numerical total. Tie hands are treated as "pushes" with the player receiving back his wager. All losing player hands result in the wagers being collected by the dealer on behalf of the gaming establishment.

In the preferred method of the present invention, a player receiving a pair of like cards as his first two cards may split this pair into two hands. An additional wager is required for splitting the pairs and the player receives an additional card on each of the split pair cards. The method then proceeds with the player, in effect, playing out two separate hands against the dealer's single hand with the outcome of each hand determined individually. In the most preferred embodiment of the present invention, a player may only split pairs once, although alternatively the gaming establishment may permit a player to keep splitting his pairs if additional pairs occur during the play of the game.

Another variation that may be allowed during the play of the method of the present invention is to allow a player to "double down". This option is similar to the "double down" option that is available in conventional Twenty-One in which, for an additional wager, a player receives one more card in his hand and that final card establishes the numerical count of the player's hand. In the preferred embodiment of the present invention, a player may double down at any time, including after having split pairs.

The method of the present invention can be practiced using fifty two card combinations other than the combination described in connection with the first preferred embodiment. For example, in another preferred embodiment, the fifty two card deck can comprise 4 deuces, 4 threes, 8 fours, 8 fives, 8 sixes, 4 sevens, 4 eights, 4 nines, 4 tens and 4 wild cards (which again can simply be Jokers). This arrangement of the deck of cards slightly changes the probability of certain hands occurring since there are slightly more lower numerical value cards in the deck; however the percentage hold in favor of the house is very close to that expected from the first preferred embodiment in which four additional fives, sixes and sevens are used.

Likewise, in still another preferred embodiment, the fifty two card deck can comprise 4 deuces, 4 threes, 4 fours, 4 fives, 8 sixes, 8 sevens, 8 eights, 4 nines, 4 tens and 4 wild cards (which again can simply be Jokers). This arrangement of the deck of cards also slightly changes the probability of certain hands occurring since there are slightly more higher numerical value cards in the deck; however the percentage hold in favor of the house is again very close to that expected from the first preferred embodiment in which four additional fives, sixes and sevens are used. Therefore, either of the three preferred embodiments can be used without significantly changing the percentages between the player and the house.

The method of the present invention has been described above in connection with a typical casino gaming environment in which the gaming establishment banks the game, also known as a "house banked game". In a house banked game, the gaming establishment runs the risk of losing and pays all winners.

In some gaming jurisdictions, such as California, house banked casino games are not permitted. In such jurisdictions, games such as Twenty-One are only permitted if one of the players at the table "banks" the game and undertakes the risk of losing and paying the other winning players. The method of the present invention would proceed in the same manner as other player banked games proceed in such jurisdictions, typically with each player at the table having the option to bank the game in turn.

The method of the present invention can also be adapted to "player banked games" jurisdictions by having one of the players at the table undertake the role of the dealer and be responsible for paying all winning wagers. The player who acts as the dealer also collects all losing wagers. As used in this application and particularly in the claims, the term "dealer" is intended to include both the gaming establishment in those jurisdictions that permit "house banked games" and one of the players at the table in those jurisdictions that only allow "player banked games."

The method of the present invention can also be adapted to a video gaming device in much the same manner as Twenty-One has been adapted to a video gaming device. The electronic gaming machine is provided with a video monitor that displays both the dealer's hand and the player's hand. The player inserts a coin or token to activate the electronic gaming machine and presses the deal button to display the hands. By pressing either the "stand" button or the "hit" button, the player determines whether to receive additional cards. The option to split pairs or to double down can also be programmed into the gaming machine. After the player completes the play of his hand, the gaming machine displays the play of the dealer's hand according the draw rules in effect for the dealer's hand. After the dealer's hand is played out, the gaming machine displays the results of the play and awards the player any winning amounts to which the player may be entitled. The method of the present invention is intended to cover both the live gaming table version of the game as well as an electronic video gaming machine version of the game.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game comprising:

a) providing a deck of playing cards consisting of four deuces, four threes, four fours, eight fives, eight sixes, eight sevens, four eights, four nines, four tens and four wild cards, each card having a numerical count equal to its face value and each wild card having a numerical count of either one or ten at the option of a player during play of the game;

b) dealing two cards to the player comprising a player's hand and two cards to a dealer comprising a dealer's hand;

c) if the player's hand has a numerical total of twenty and the dealer's hand has a numerical total of twenty, the result is a tie hand;

d) if the player's hand has a numerical total of twenty and the dealer's hand has a numerical total of less than twenty, the player's hand is the winning hand;

d) if the player's hand has a numerical total of less than twenty and the dealer's hand has a numerical total of twenty, the dealer's hand is the winning hand;

e) if both the player's hand or the dealer's hand have a numerical total of less than twenty, the player standing or drawing additional cards as the player desires;

f) if the player draws a card resulting in the numerical total of the player's hand exceeding twenty, the sum of ten is subtracted from the numerical total of the player's hand to achieve a final numerical total for the player's hand;

g) the dealer standing when the dealer's hand has a numerical total of seventeen or more and the dealer drawing an additional card when the dealer's hand has a numerical total of sixteen or less;

h) if the dealer draws a card resulting in the numerical total of the dealer's hand exceeding twenty, the sum of ten is subtracted from the numerical total of the dealer's hand to achieve a final numerical total for the dealer's hand, unless the numerical total of the dealer's hand is exactly twenty-one, in which case the sum of ten is subtracted from the numerical total of the dealer's hand and the dealer draws one additional card to achieve the final numerical total for the dealer's hand;

i) comparing the final numerical total of the dealer's hand to the final numerical total of the player's hand; and j) determining the winning hand to be the hand with the higher final numerical total.

2. The method of claim 1 further including the step of determining a winning hand to be any hand having two tens as the first two cards unless both the player's hand and the dealer's hand have two tens as the first two cards in which case the result is a tie hand.

3. A method of playing a card game comprising:

a) a player making a wager to be eligible to participate in the card game;

b) providing a deck of playing cards consisting of four deuces, four threes, four fours, eight fives, eight sixes, eight sevens, four eights, four nines, four tens and four wild cards, each card having a numerical count equal to its face value and each wild card having a numerical count of either one or ten at the option of a player during the play of the game;

c) dealing two cards to the player comprising a player's hand and two cards to a dealer comprising a dealer's hand;

d) if the player's hand has a numerical total of twenty and the dealer's hand has a numerical total of twenty, the result is a tie hand;

e) if the player's hand has a numerical total of twenty and the dealer's hand has a numerical total of less than twenty, the player's hand is the winning hand;

f) if the player's hand has a numerical total of less than twenty and the dealer's hand has a numerical total of twenty, the dealer's hand is the winning hand;

g) if both the player's hand or the dealer's hand have a numerical total of less than twenty, the player standing or drawing additional cards as the player desires;

h) if the player draws a card resulting in the numerical total of the player's hand exceeding twenty, the sum of ten is subtracted from the numerical total of the player's hand to achieve a final numerical total for the player's hand;

i) the dealer standing when the dealer's hand has a numerical total of seventeen or more and the dealer drawing an additional card when the dealer's hand has a numerical total of sixteen or less;

j) if the dealer draws a card resulting in the numerical total of the dealer's hand exceeding twenty, the sum of ten is subtracted from the numerical total of the dealer's hand to achieve a final numerical total for the dealer's hand, unless the numerical total of the dealer's hand is exactly twenty-one, in which case the sum of ten is subtracted from the numerical total of the dealer's hand and the dealer draws one additional card to achieve the final numerical total for the dealer's hand;

k) comparing the final numerical total of the dealer's hand to the final numerical total of the player's hand; and l) determining the winning hand to be the hand with the higher final numerical total and paying the player an amount based on the player's wager if the player's hand is the winning hand.

4. The method of claim 3 in which the amount paid to the player is one-to-one odds based on the amount of the player's wager.

5. The method of claim 3 further including the step of determining a winning hand to be any hand having two tens as the first two cards unless both the player's hand and the dealer's hand have two tens as the first two cards in which case the result is a tie hand.

6. A method of playing a card game comprising:

a) providing a deck of playing cards consisting of deuces, threes, fours, fives, sixes, sevens, eights, nines, tens and wild cards, each card having a numerical count equal to its face value and each wild card having a numerical count of either one or ten at the option of a player during the play of the game;

b) dealing two cards to the player comprising a player's hand and two cards to a dealer comprising a dealer's hand, c) the player standing or receiving additional cards from the dealer as the player desires, e) the dealer standing when the dealer's hand has a numerical count of seventeen or more and the dealer receiving an additional card when the dealer's hand has a numerical count of sixteen or less, f) comparing the numerical count of the dealer's hand to the numerical count of the player's hand, and g) determining the winning hand to be the hand with the higher numerical count.

7. The method of claim 6 in which the deck of playing cards comprises four deuces, four threes, four fours, eight fives, eight sixes, eight sevens, four eights, four nines, four tens and four wild cards.

8. The method of claim 6 in which the deck of playing cards comprises four deuces, four threes, eight fours, eight fives, eight sixes, four sevens, four eights, four nines, four tens and four wild cards.

9. The method of claim 6 in which the deck of playing cards comprises four deuces, four threes, four fours, four fives, eight sixes, eight sevens, eight eights, four nines, four tens and four wild cards.

10. The method of claim 6 further including the step of determining a winning hand to be any hand having two tens as the first two cards unless both the player's hand and the dealer's hand have two tens as the first two cards in which case the result is a tie hand.

11. A method of playing a card game comprising:

a) a player making a wager to be eligible to participate in the card game;

b) providing a deck of playing cards consisting of deuces, threes, fours, fives, sixes, sevens, eights, nines, tens and wild cards, each card having a numerical count equal to its face value and each wild card having a numerical count of either one or ten at the option of a player during the play of the game;

c) dealing two cards to the player comprising a player's hand and two cards to a dealer comprising a dealer's hand, d) the player standing or receiving additional cards from the dealer as the player desires, f) the dealer standing when the dealer's hand has a numerical count of seventeen or more and the dealer receiving an additional card when the dealer's hand has a numerical count of sixteen or less, g) comparing the numerical count of the dealer's hand to the numerical count of the player's hand, and h) determining the winning hand to be the hand with the higher numerical count and paying the player an amount based on the player's wager if the player's hand is the winning hand.

12. The method of claim 11 in which the amount paid to the player is one-to-one odds based on the amount of the player's wager.

13. The method of claim 11 in which the deck of playing cards comprises four deuces, four threes, four fours, eight fives, eight sixes, eight sevens, four eights, four nines, four tens and four wild cards.

14. The method of claim 11 in which the deck of playing cards comprises four deuces, four threes, eight fours, eight fives, eight sixes, four sevens, four eights, four nines, four tens and four wild cards.

15. The method of claim 11 in which the deck of playing cards comprises four deuces, four threes, four fours, four fives, eight sixes, eight sevens, eight eights, four nines, four tens and four wild cards.

16. The method of claim 11 further including the step of determining a winning hand to be any hand having two tens as the first two cards unless both the player's hand and the dealer's hand have two tens as the first two cards in which case the result is a tie hand.

* * * * *